United States Patent [19]

Nijman

[11] 4,288,918

[45] Sep. 15, 1981

[54] METHOD AND APPARATUS FOR MAKING A CRIMPED, INSULATION-PIERCE ELECTRICAL CONNECTION

[75] Inventor: John P. Nijman, West Hill, Canada

[73] Assignee: Bunker Ramo Corporation, Oak Brook, Ill.

[21] Appl. No.: 24,114

[22] Filed: Mar. 26, 1979

Related U.S. Application Data

[60] Division of Ser. No. 875,856, Feb. 7, 1978, Pat. No. 4,159,156, which is a continuation of Ser. No. 703,637, Oct. 7, 1976, abandoned.

[51] Int. Cl.[3] ..... H01R 43/04

[52] U.S. Cl. ..... 29/868; 29/753; 29/751

[58] Field of Search ..... 29/753, 509, 513, 751, 29/566, 630 R, 749, 630 A, 868; 339/276 T, 278 T, 97 P; 72/410

[56] References Cited

U.S. PATENT DOCUMENTS

| | | | |
|---|---|---|---|
| 2,873,434 | 2/1959 | Drum et al. | 29/630 A |
| 3,145,261 | 8/1964 | Forney, Jr. . | |
| 3,393,438 | 7/1968 | Marley et al. | 72/410 X |
| 3,571,890 | 3/1971 | Brehm et al. | 29/751 X |
| 3,657,682 | 4/1972 | Iversen | 339/97 P |
| 3,866,294 | 2/1975 | McCaughey | 29/753 X |
| 3,867,005 | 2/1975 | Hoppe, Jr. . | |
| 3,902,154 | 8/1975 | McKee . | |
| 3,952,392 | 4/1976 | Nijam et al. | 29/749 |
| 3,959,868 | 6/1976 | Mathe | 29/753 X |
| 4,038,745 | 8/1977 | Nijam | 29/751 X |
| 4,048,710 | 9/1977 | Nijam | 29/753 X |

*Primary Examiner*—Ervin M. Combs
*Assistant Examiner*—C. J. Arbes
*Attorney, Agent, or Firm*—Hill, Van Santen, Steadman, Chiara & Simpson

[57] ABSTRACT

An insulated conductor is terminated in an insulation-opening portion of an electrical contact and the contact jaws are crimped over the conductor to secure the conductor therein. A tool includes a pair of cutting edges and crimping surfaces for cutting and folding over sections of the contact jaws as the tool presses an insulated conductor into an insulation-opening notch formed by the contact jaws. The tool includes a forward end having a surface for engaging and pressing the conductor into the notch, the surface acting against the conductor as a stop to limit the depth of cut of the cutting edges. The tool may also be used after conductor insertion by other techniques to perform the crimping operation. The side surfaces of the tool slidingly engage the cut edges of the contact jaws and prevent an inward movement of the jaws during cutting and crimping. The resulting electrical connection is mechanically secure in that a normally open conductor-receiving channel is closed by the peeled over sections of the contact jaws there by preventing outward movement of the conductor. The contact structure is of particular advantage where stranded wire is used in that the clamping action of the peeled over sections prevents relaxation distortions of the conductor which has become distorted during insertion and thus prevents pressure drop at the contact jaws which can result from relaxation distortion.

21 Claims, 4 Drawing Figures

Fig. 1
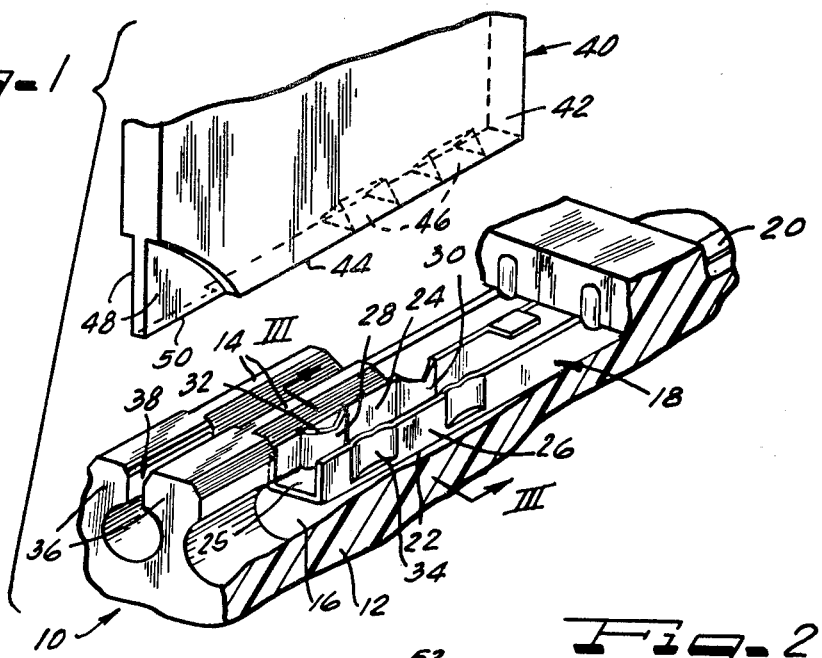
Fig. 2
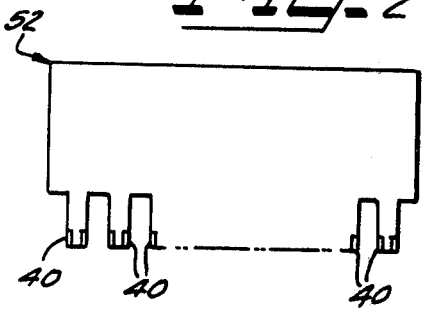
Fig. 3
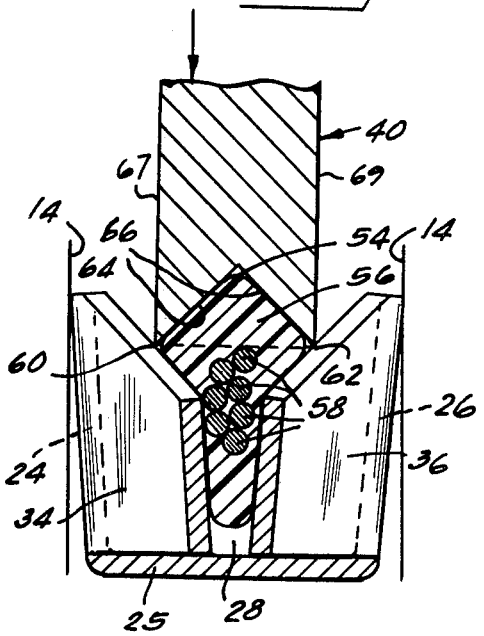
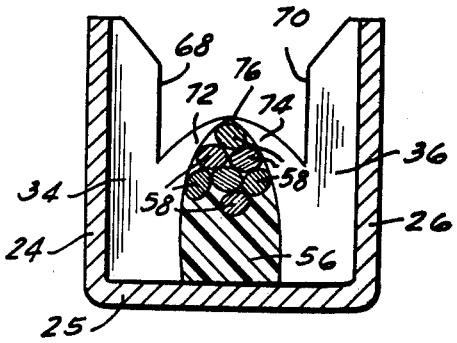
Fig. 4

METHOD AND APPARATUS FOR MAKING A CRIMPED, INSULATION-PIERCE ELECTRICAL CONNECTION

This is a division of application Ser. No. 875,856, filed Feb. 7, 1978, now Pat. No. 4,159,156, issued June 26, 1979, which is a continuation of Ser. No. 703,637, filed Oct. 7, 1976, now abandoned.

BACKGROUND OF THE INVENTION

1. Field of the Invention

This invention relates to solderless electrical connections, and is particularly concerned with insulation-opening electrical connections and a method and apparatus for making a crimped, insulation-opening electrical connection.

2. Description of the Prior Art

The prior art generally recognizes many types of crimped electrical connections. For example, a contact lug may be provided with a sleeve-type connecting portion in which one section is folded tightly about a stripped end of a conductor, while another section is folded tightly about the insulation adjacent the stripped end. Apparatus for accomplishing this crimping operation generally includes a pair of dies and apparatus for moving at least one of the dies toward the other to squeeze the appropriate contact portions therebetween.

It is generally well known in the art to press an insulated conductor, either solid wire or stranded wire, into an insulation-opening notch of a terminating portion of an electrical contact. One such contact is disclosed by Paul Hoppe Jr. in U.S. Pat. No. 3,867,005 as comprising a pair of insulation-piercing notches, each of which is formed by a pair of inwardly extending detents in parallel side walls of a U-shaped portion of an electrical contact. In his U.S. patent application Ser. No. 482,457, issued June 1, 1976 as U.S. Pat. No. 3,959,868, Istvan Mathe discloses a hand tool for inserting an insulated conductor into an insulation-opening contact of the type disclosed in U.S. Pat. No. 3,867,005. Inasmuch as it sometimes is desirable to insert and terminate a plurality of insulated conductors at the same time, the insertion blade is provided in multiple as disclosed by Nijman et al in their U.S. patent application Ser. Pat. No. 432,484, filed Jan. 11, 1974, now U.S. 3,952,392, issued Apr. 27, 1976.

The term "insulation-opening" as used herein is meant to encompass all techniques in which the insulation covering a core of solid or stranded wire is cut, pierced pressed, broken or torn open by one or more elements to gain access and electrical contact to the core.

Although the insulation-opening techniques provide a good electrical and mechanical connection, it has been found that in certain instances, a loosening effect of the connection may occur. This is particularly a problem with stranded conductors which undergo distortion during insertion and which have a clamping pressure applied thereto by the insulation-opening contact elements. The subsequent application of tensile forces, axially and/or transversely, to the conductors held by such pressure causes a relaxation type of deformation and strand movement and repositioning so as to effect a drop in connection pressure. Of course, this condition is highly undesirable and should be eliminated.

SUMMARY OF THE INVENTION

It is therefore the primary object of the invention to provide a new and improved electrical connection between an insulation-opening contact portion and an insulated conductor in which the conductor is mechanically secured in the electrical contact.

A more specific object of the invention is to provide an electrical connection in which the electrical conductor is mechanically secured by the insulation-opening contact jaws of an electrical contact. Another object of the invention is to provide a method of making a crimped, insulation-opening electrical connection between an insulated conductor and an insulation-opening portion of an electrical contact.

Another object of the invention is to provide a tool for crimping an insulation-piercing contact portion, or at least a section thereof over an electrically terminated conductor.

Another object of the invention is to provide a tool for inserting an insulated conductor into an insulation-opening portion of an electrical contact and at the same time crimping sections of the insulation-opening contact jaws over the insulated conductor.

Although reference is made herein to a specific insulation-opening portion of an electrical contact, the invention is applicable to all insulation-opening contacts in which at least one portion of the contact extends to a point adjacent the position of an inserted conductor. Therefore, although crimping of a contact jaw is specifically disclosed herein, crimping of other contact portions, such as a flange-type contact portion, during or subsequent to the insertion operation can be accomplished with a tool adapted for a particular contact structure.

According to the invention, an electrical connection comprises an insulated conductor which includes at least one electrical conductor within an insulating jacket, an electrical contact including an insulation-opening portion and having a contact portion which extends through the insulation into electrical contact with the conductor, and a section of the contact portion folded over the insulated conductor to clamp the conductor against either another portion of the contact or against a contact supporting structure. Usually, the insulation-piercing portion will include a pair of second wall portions extending from the first wall portion in a U-shaped configuration on opposite sides of the insulated conductor, and each of the second wall portions will include a section folded over the insulated conductor toward the other section to clamp the insulated conductor between the first and second wall portions.

In a method of terminating an insulated conductor in an insulation-opening contact portion in which the insulated conductor is pressed into an insulation-opening notch formed by at least one insulation-piercing contact jaw extending at an angle to a supporting member which is either a portion of the contact, a dielectric contact support or the like, a specific improvement comprises the step of crimping a section of the contact jaw over the conductor to clamp the conductor against the supporting member and, consequently, completely or at least substantially close the insulation-opening notch. In performing the crimping step, the attendant steps of cutting a section of contact jaw and folding the cut section over the conductor are accomplished. The cutting of the contact jaw can be thought of as peeling a section of the contact jaw and the step of folding the section over the conductor may be performed contemporaneously during peeling. In addition, the crimping step may advantageously be performed simultaneously with the step of inserting the conductor into the insulation-opening notch.

A tool for inserting an insulated conductor into an insulation-opening portion of an electrical contact which has an outwardly open notch for receiving the conductor transversely of the axis of the conductor and a roll portion adjacent the notch, comprises a conductor insertion member for engaging and pressing an insulated conductor into the notch, and a crimping means are connected to the insertion member for engaging and crimping a section of the roll portion over the conductor and close at least a portion of the notch, the insertion member including a forward end for engaging the conductor and the crimping means comprising a cutting edge on the forward end to cut a section of the wall portion and an oblique surface extending from the cutting edge for guiding and folding the cut section over the conductor. A tool for securing a conductor already inserted in such a contact may advantageously have the same structure and, in either case, the insertion member is in the form of a blade which has an end surface which engages the insulated conductor and which, when the insulated conductor is completely inserted, acts as a stop to limit the depth of cut.

BRIEF DESCRIPTION OF THE DRAWINGS

Other objects, features and advantages of the invention, its organization, construction and operation will be best understood from the following detailed description, taken in conjunction with the accompanying drawing, on which:

FIG. 1 is an enlarged view of a portion of an electrical contact supported by a dielectric insert with an insertion tool, constructed in accordance with the invention, poised as the same would be to accomplish an insertion and termination operation;

FIG. 2 is a plan view of a plurality of insertion blades carried on a common support, as would be employed in a machine for performing simultaneous insertions of a plurality of insulated conductors;

FIG. 3 is a sectional view taken substantially along the line III—III of FIG. 1 with an insertion blade in a position approximately at the time of initiation of insertion; and FIG. 4 is a sectional view, taken substantially along the line III—III of FIG. 1 illustrating the condition of the electrical contact after completion of an insertion and crimping operation.

DESCRIPTION OF THE PREFERRED EMBODIMENTS

Referring to FIG. 1, a portion of an electrical connector is generally illustrated at 10 as comprising a dielectric insert 12 having a plurality of parallel barriers 14 extending therefrom, the barriers 14 generally defining slots therebetween. The dielectric insert 12 includes a surface 16 between the barriers 14 which at least partially supports an electrical contact 18.

The electrical conductor 18 includes an active portion 20 which is not illustrated in detail but which may be in the form of a male contact, female contact any similar type of mating, or lug contact. The electrical contact 18 also includes a U-shaped terminating portion 22 having a pair of side walls 24 and 26 which extend from a bottom wall 25. Detents in the side walls 24 and 26 define a pair of insulation piercing notches 28 and 30. Each of the notches are defined, at least in part, but a wall portion 32 and a wall portion 34. Although a specific type of insulation-piercing notch is disclosed herein, any of the insulation-piercing structures set forth in the above-identified patents or structures similar to may be utilized in practicing the invention, as will become evident from the following description.

At what is generally termed the "rear" of an electrical connector, the barriers 14 develop into different shapes and dimensions so as to form between a pair of wider portions 36 a constricted strain relief 38.

As generally disclosed above, an insulated conductor is pressed into the U-shaped channel formed by the side walls 24 and 26 into the notches 28 and 30 whereupon the contact jaws open the insulation of an insulated conductor and electrically contact the conductor (conductors) therein. The same occurs in the case of the present invention in that an insertion blade 40 engages and presses an insulated conductor into the terminating portion of the electrical contact to effect a similar electrical connection. The present invention, however, goes a step further in that the conductor is not only gripped by the contact jaws and by the strain relief in that a portion of each contact jaw is peeled away and bent over the conductor so as to grip the same between that portion of the contact jaws and the bottom wall 25, at the same time closing the normally outwardly opening insulation-piercing notch.

In order to accomplish the electrical connection of the invention, the tool blade 40 is provided with a forward end 42 which has a generally planar forward surface 44 for engaging and pressing an insulated conductor into the insulation-piercing portion of the electrical contact 18. At positions aligned with the insulation-piercing notches 28 and 30, the blade 40 is provided with respective crimping means 46, which will be explained in greater detail below, which engage and crimp portions of the respective contact jaws over the insulated conductor.

In addition to the crimping means 46, the insertion blade 40 is provided with a pair of recesses 48 which define a strain relief insertion portion 50, aligned with the crimping means 46, for engaging and pressing a corresponding portion of an insulated conductor into the strain relief defined by the elements 36 and 38.

FIG. 2 illustrates a plurality of insertion blades 40 supported by a common connecting and support member 52. This type of blade would be employed in an insertion tool of the type disclosed in the above mentioned Ser. No. 432,484.

Turning now to FIG. 3, an insertion tool, or more specifically an individual blade 40, is illustrated as the same is moved in the direction of the arrow to insert an insulated conductor into an insulation piercing portion of an electrical contact. The conductor 54 illustrated includes insulation 56 which surrounds a stranded wire which comprises a plurality of conductors 58. Each of the crimping means is illustrated as comprising a first cutting edge 60, a second cutting edge 62 and a pair of intersecting surfaces 64 and 66 which are divergent toward and intersect the plane of the end surface 44 at the side surfaces of the blade 40. As illustrated in FIG. 3, the conductor 54 is undergoing a deformation as it is being forced between the contact jaws 34 and 36. This deformation becomes more apparent in FIG. 4 which illustrates the completion of termination.

The cutting edges 60 and 62 cut and peel away sections of the contact jaws 34 and 36 along respective cut edges 68 and 70, such sections being referenced to 72 and 74 in FIG. 4. The sections 72 and 74, as the same are being peeled from the contact jaws 34 and 36 engage and are folded over by the surfaces 64 and 66, respectively so as to converge in an area indicated at 76. As such, the sections 72 and 74 are folded over the insulated conductor 54 to close the insulation-piercing notch and clamp the conductor between the contact jaws and the bottom wall 25 of the insulation-piercing portion 22 of the electrical contact 18.

During insertion, the contact may also undergo a deformation, after which the resiliency of the contact provides a gripping action on the conductor. In the specific structure illustrated, the side surfaces of the parallel barriers 14, schematically shown in FIG. 3, are engaged by the contact side walls 24 and 26 during conductor insertion to provide stabilization of the contact. Consequently, the tool blade 40 is stabilized during the cutting operation in that the side surfaces 67 and 69 slidingly engage and are guided by the cut edges 68 and 70 as such edges are generated. Accordingly, any structure for restricting or limiting the opening action of the notch will provide similar stability of the particular contact and tool. In addition, the side surfaces 67 and 69 engage the cut edges and prevent an inward deflection of the jaws.

As mentioned above, not only is a good electrical contact achieved, but an improved and effective mechanical clamping of the conductor to the terminal is effected. In addition to providing an upper capture of the conductor by the crimped jaws, the inner surface of the folded portion of the jaws provide an increase in contact surface area in engagement with the metallic strands as shown in FIG. 4.

Although I have described my invention by reference to particular illustrated embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a method of terminating an insulated conductor in an insulation-piercing contact portion in which a conductor is engaged by an insertion blade and pressed into an insulation-piercing notch formed by at least one insulation-piercing contact jaw which extends at an angle to a supporting member, the improvement therein comprising the steps of:

cutting a section of the contact jaw; and simultaneously with the step of cutting, folding the cut section over the conductor.

2. In a method of terminating an insulated conductor in an insulation-piercing contact portion in which a conductor is engaged by an insertion blade having a cutting edge and pressed into an insulation-piercing notch formed by at least one insulation-piercing contact jaw which extends at an angle to a supporting member, the improvement therein comprising the steps of:

cutting a section of the contact jaw with the tool cutting edge during pressing of the conductor into the contact portion; and folding the cut section over the conductor.

3. In a method of terminating an insulated conductor in an insulation-piercing contact portion in which a conductor is engaged by an insertion blade and pressed into an insulation-piercing notch formed by at least one insulation-piercing contact jaw which extends at an angle to a supporting member, the improvement therein comprising the steps of:

peeling a section of the contact jaw; and contemporaneously folding the section over the conductor.

4. The method of claim 3, wherein the step of peeling and folding are performed simultaneously with the pressing of the conductor into the insulation-piercing notch.

5. In a method of terminating and electrically contacting the core of an insulated conductor in an insulation-opening contact in which an insulated conductor is pressed into an insulation-opening notch formed by at least one insulation-opening contact jaw which contacts the core of the conductor over a given area, the improvement therein comprising the steps of:

cutting a section of the contact jaw;

contemporaneously folding the cut section of the contact jaw over the conductor; and contemporaneously increasing the contact area of the contact jaw with the core of the conductor.

6. A tool for inserting and securing an insulated conductor in an insulation-piercing portion of an electrical contact, which portion has an outwardly open notch for receiving a conductor transversely of the axis of the conductor and a pair of spaced apart contact jaws defining at least a portion of the notch, said tool comprising:

a blade including an end surface for engaging and pressing a conductor into the notch; and a pair of cutters carried spaced apart on said blade for engaging respective contact jaws to cut and convergently peel portions of the contact jaws over the conductor.

7. The tool set forth in claim 6, wherein said pair of cutters includes a pair of surfaces divergently extending toward said end surface, and a pair of cutting edges located at the plane of intersection of said divergent and end surfaces.

8. A tool for securing a conductor in an insulation-piercing portion of an electrical contact, the insulation-piercing portion having an outwardly open notch defined by at least one contact wall portion and receiving an insulated conductor supported and seated therein, the tool comprising:

a blade;

cutting means carried on said blade for engaging and cutting a section of the wall portion; and crimping means carried on said blade for folding the cut section over the seated conductor thereby securing the conductor in the notch.

9. The tool set forth in claim 8, wherein said blade includes a stop surface for engaging the seated conductor to limit the depth of cut of said cutting means.

10. The tool set forth in claim 8, wherein said blade invludes a forward surface, said crimping means includes a crimping surface oblique to and intersecting said forward surface, and said cutting means includes an edge at the intersection of said forward and crimping surfaces.

11. The tool set forth in claim 8, wherein the electrical contact has a strain relief longitudinally aligned with said notch, and wherein said tool comprises:

a portion on said blade for engaging and pressing the conductor into the strain relief.

12. The tool set forth in claim 11, wherein said blade includes at least one recessed portion defining a reduced thickness section which constitutes said portion for pressing the conductor into the strain relief.

13. A tool for securing an insulated connector in an electrical contact which includes a first pair of spaced apart contact jaws and a second pair of spaced apart contact jaws aligned with and spaced apart from the first contact jaws, the contact jaws open outwardly to receive, electrically contact and support an insulated conductor, said tool comprising:

a blade;

first and second pairs of cutting edges on said blade for engaging and cutting sections of respective ones of said first contact jaws and second contact jaws; and first and second pairs of crimping surfaces extending from said first and second pairs of cutting edges, respectively, for folding the respective cut sections over a conductor supported in said contact jaws.

14. The tool set forth in claim 13, wherein said blade includes a stop surface for engaging a supported conductor and limiting the depth of cut.

15. A tool for inserting and securing an insulated conductor in an insulation-opening portion of an electrical contact, which portion has an outwardly open notch for receiving a conductor transversely of the axis of the conductor and a pair of spaced apart transversely stabilized contact elements defining at least a portion of the notch, said tool comprising:

a blade including an end surface for engaging and pressing a conductor into the notch;

a pair of cutters carried spaced apart on said blade for engaging respective contact elements to cut and convergently peel portions of the contact jaws over the conductor, the cutting generating cut edges on the contact jaw; and at least one side surface on said blade for slidingly engaging and being guided by a respective cut edge to stabilize the movement of said tool in the direction of said contact.

16. A tool for inserting and securing an insulated conductor in an insulation-piercing portion of an electrical contact, which portion has an outwardly open notch for receiving a conductor transversely of the axis of the conductor and a pair of spaced apart contact jaws defining at least a portion of the notch, said tool comprising:

a blade including an end surface for engaging and pressing a conductor into the notch;

a pair of cutters carried spaced apart on said blade for engaging respective contact jaws to cut sections of the contact jaws; and at least one surface on said blade between said cutters for guiding the cut sections over and in gripping relation to the cutters.

17. A tool for inserting insulated conductors into respective insulation-piercing portions of electrical contacts, which portions each have an outwardly open notch formed from a pair of contact sidewalls, comprising:

a member including an element for engaging and pressing an insulated conductor into a notch; and crimping means carried by said member for engaging and cutting wall portions of the contact sidewalls and bending the cut portions over an inserted insulated conductor to sever the insulation and additionally electrically contact the conductor.

18. The tool of claim 17, wherein said crimping means comprises:

a pair of cutting edges for engaging and cutting respective sidewalls; and at least one surface for slidingly engaging the cut portions and guiding the same inwardly.

19. The tool of claim 17, wherein said crimping means comprises:

a pair of cutting edges for engaging and cutting respective sidewalls; and a pair of surfaces for slidingly engaging the cut portions and guiding the same inwardly.

20. A tool for inserting an insulated conductor into an insulation piercing portion of an electrical contact, which portion has an outwardly open notch for receiving a conductor transversely of the axis of the conductor and a wall portion adjacent the notch, said tool comprising:

a conductor insertion member including a forward end for engaging and pressing an insulated conductor into the notch; and crimping means connected to said insertion member for engaging and crimping a section of said wall portion over the conductor and close at least a portion of the notch, said crimping means comprising a cutting edge on said forward end to cut a section of the wall portion, and an oblique surface extending from said cutting edge for guiding and folding the cut section over the conductor.

21. A tool for inserting and securing an insulated conductor in an electrical contact which includes a pair of spaced apart first insulation-piercing jaws and a pair of spaced apart second insulation-piercing jaws spaced from the pair of first jaws, each of the pairs of jaws defining an outwardly open notch for receiving a conductor transversely of the axis of the conductor, the tool comprising:

a blade including a forward surface for engaging and pressing a conductor into the notches;

first crimping means carried on said blade for engaging and crimping portions of the first jaws over the conductor; and second crimping means carried on said blade for engaging and crimping portions of said second jaws over the conductor, said forward surface being a planar surface and each of said crimping means comprising a pair of crimping surfaces directed rearwardly from said planar surface and toward each other and a pair of cutting edges at the intersections of said crimping surfaces with said planar surface.

* * * * *